US007177436B2

(12) United States Patent
Frieding et al.

(10) Patent No.: US 7,177,436 B2
(45) Date of Patent: Feb. 13, 2007

(54) COMPONENT ARRANGED DIRECTLY ON A T-COIL

(75) Inventors: Jan Frieding, Rapperswil (CH); Jürg Sudan, Zürich (CH)

(73) Assignee: Phonak AG, Stafa (CH)

( * ) Notice: Subject to any disclaimer, the term of this patent is extended or adjusted under 35 U.S.C. 154(b) by 259 days.

(21) Appl. No.: 10/810,945

(22) Filed: Mar. 26, 2004

(65) Prior Publication Data

US 2005/0213789 A1 Sep. 29, 2005

(51) Int. Cl.
*H04R 25/00* (2006.01)

(52) U.S. Cl. ..... 381/331; 381/324

(58) Field of Classification Search ..... 381/324, 381/331, 312; 600/25; 379/52, 403, 433
See application file for complete search history.

(56) References Cited

U.S. PATENT DOCUMENTS

| | | | | |
|---|---|---|---|---|
| 6,694,034 | B2 * | 2/2004 | Julstrom et al. | 381/315 |
| 2003/0031339 | A1 * | 2/2003 | Marshall et al. | 381/400 |

FOREIGN PATENT DOCUMENTS

| | | | |
|---|---|---|---|
| DE | 19 38 381 | A | 2/1971 |
| DE | 198 12 836 | A | 9/1999 |
| DE | 101 05 416 | A | 8/2002 |
| WO | 03/069640 | A | 8/2003 |

* cited by examiner

*Primary Examiner*—Sinh Tran
*Assistant Examiner*—Brian Ensey
(74) *Attorney, Agent, or Firm*—Pearne & Gordon LLP

(57) ABSTRACT

At small electric devices, such as in particular medical devices, as e.g. hearing devices, very small electric coils (1) are used. Especially with hearing devices e.g. so-called t-coils are used. Those t-coils are considered and arranged at hearing devices as inductivities with parasitic effects. Due to the very limited space, it is proposed that at very small coils, which are used within the mentioned electric or electronic small devices, the connections of the coil (5, 7) are interlinked directly at the coil (1) over a component (9), an assembly group and/or a circuit. The connections of the coil (5, 7) are arranged on one or more screens or small panels which are firmly arranged on or at the coil comprising so-called pads (6, 8), which connections are interlinked with the use of a capacitor or condenser (9) and onto which pads external connections (11, 13) are directed for the external connecting of the coil.

17 Claims, 3 Drawing Sheets

COMPONENT ARRANGED DIRECTLY ON A T-COIL

BACKGROUND OF THE INVENTION (1) Field of the Invention

The present invention refers to a coil assembly. More specifically, to a process for the production as well as uses of the coil assembly.

(2) Description of Related Art

In small electrical devices, such as in particular devices for medicine as e.g. hearing devices, very small electric coils are used. In hearing devices so-called t-coils or telephone coils e.g. are used. Such t-coils are considered and arranged in hearing devices as inductivities with parasitic effects. This physical coil therefore has a performance Q and a resonant frequency fres.

For the reception of remote control signals, one wants e.g. to lower resonant frequency of typically 150 kHz to the frequency of transmission. This usually happens when using one or more capacitors parallel to the coil.

In particular with the mentioned smallest devices, such as e.g. hearing devices, it is often impossible, due to the very small dimension of electronics or the dimension or number, respectively, of necessary capacitors, to arrange them within the electronic assembly group. The decade is not sufficient and a further external capacitor has to be used.

BRIEF SUMMARY OF THE INVENTION

One subject of the present invention is to propose a possibility of how a further capacitor can be arranged at limited room conditions within small electrical devices.

In general, the subject lies in small electrical or electronical devices within electronics with at least one coil to increase the amount of internal components to be arranged in order to fulfil corresponding requirements to electronics.

According to the invention, the above mentioned problems are solved by using a coil assembly and arranging directly on or at the coil a component or circuit at the connections of the coil to interlink those connections.

Preferably, the coil has solderable, radial connections which are thus set at a distance that arranging of the component or the circuit is possible.

According to a further design, the connections are arranged on at least one at or on the coil adapting or overlying print, such as e.g. a small plastic panel with two pads mounted on it, on which also the component or circuit may be arranged for interlinking the two connections.

The component or the assembly (surface mounted device) may be e.g. a capacitor which is arranged on the front side of a rod-like coil and is connected to the two connections which on their part are connected to connections from outside, such as e.g. cords or wires.

The coil, equipped as proposed according to the present invention, such as e.g. a so-called t-coil, does not have to be in any case a cylinder- or rod-like coil, but also the use of ring-shaped coils or different suitably designed coils is possible.

It is also possible that two or more cylinder-like or rod-like coils are used at whose connections e.g. a capacitor is arranged. It may also be about coils which are arranged at a transformer or which are arranged concentrically.

Further proposed is a process for the production of a coil assembly. Accordingly, it is first proposed to direct the connections of the coil on to so-called connection pads to be fixed, such as e.g. by soldering, welding or be bonding, afterwards to arrange the component or the circuit with which the two connections of the coil are connected to each other and finally to connect the connections of the coil on the pads with connections supplied from the outside, such as e.g. cords or wires. The component, such as the capacitor, is soldered simultaneously on both sides while the cords or wires are connected individually to the connections on the pads. The coils assembly as proposed according to the present invention is in particular suitable for the use within a electronic of smallest medical devices, such as e.g. a hearing device.

BRIEF DESCRIPTION OF THE SEVERAL VIEWS OF THE DRAWINGS

The following description of an implementation example will explain this invention in more detail with reference to the attached drawings in which.

DETAILED DESCRIPTION OF THE INVENTION

Figure 1:
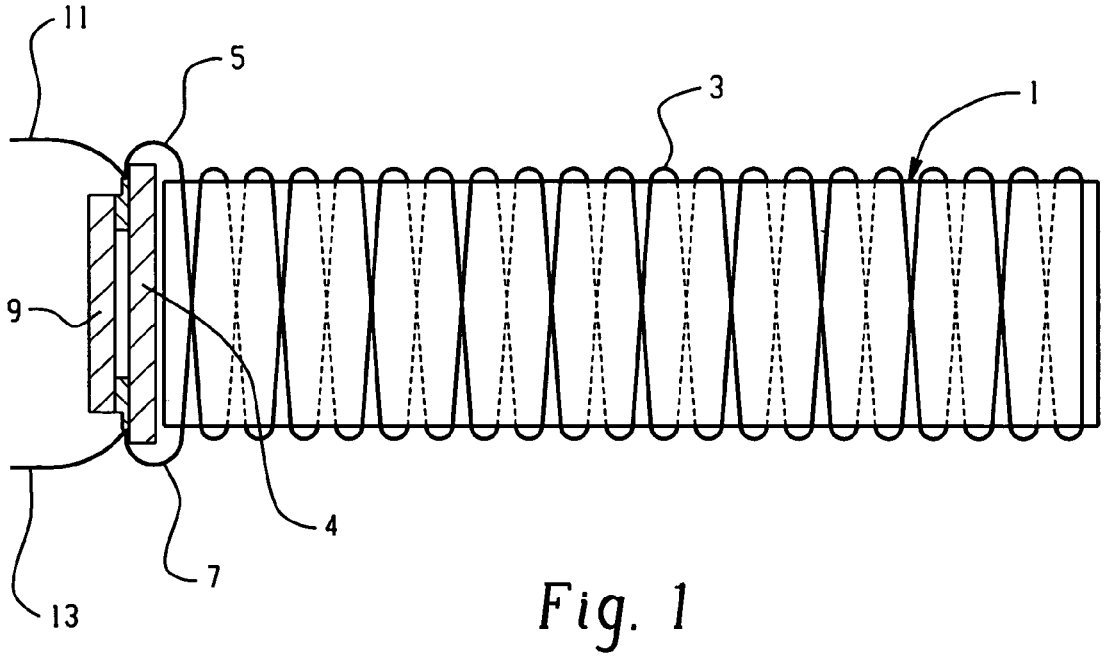
FIG. 1 is a schematic longitudinal view of a cylinder-like coil according to the present invention.

FIG. 1 shows in longitudinal view schematically a rod- or cylinder-like coil comprising a coil body 1 with windings 3 arranged on the coil body. Of course, the view is an x-times magnified enlargement but in fact the coils as proposed according to the present invention, usually are very small coils which have dimensions of e.g. maximal length of some millimetres. On the front side of the cylindrical-like coil are the two connections 5 and 7 of the coil, which are interlinked over a capacitor 9. At the same time the two connections 5 and 7 are connected to the connections 11 and 13 supplied from the outside.

Figure 2:
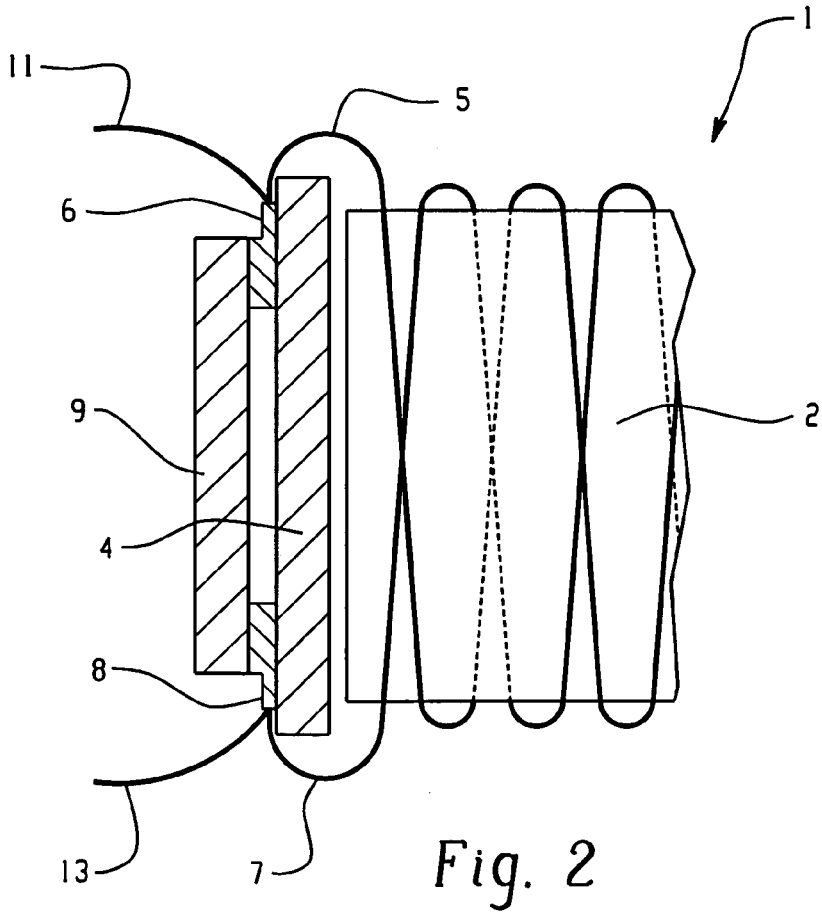
FIG. 2 is an cut-out of the coil of FIG. 1, FIG. 3 a further design of a ring-shaped coil, FIG. 4 a schematic illustration for the better understanding of the present invention, FIG. 5 two coaxially arranged cylinder-like coils.

In FIG. 2 the front side of the coil from FIG. 1 is shown in an enlarged view in which the two connections 5 and 7 are clearly visible, which are directed on two connecting pads 6 and 8, which pads are arranged on a small plate or panel 4. The connections are soldered on these preferably metal pads. Connecting the two connections 5 and 7 a capacitor 9 is arranged and additionally the two external connections 11 and 13 are directed onto the connecting pads 6 and 8.

Of course, the cylinder-like or rod-like coil according to FIGS. 1 and 2 is only an example and also the use of cylinder-like coil bodies is not obligatory. Especially at smallest coils, coil windings are very often used without a respective coil body.

Figure 3:
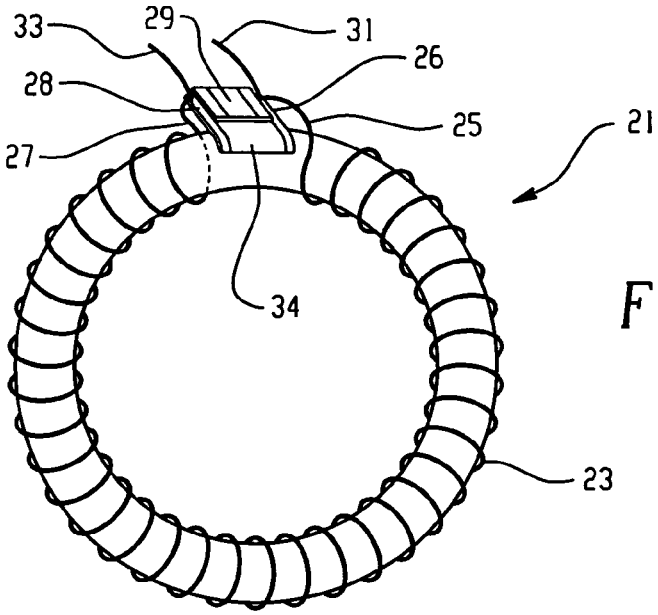

In addition, it is e.g. also possible to use a ring-shaped coil or a so-called toroid coil, which is schematically shown in FIG. 3. The ring-shaped coil 21 has windings 23 which have at both ends the connections 25 and 27 which are again preferably soldered on metal pads 26 and 28 which pads are bonded on a plate or panel 34 which e.g. is made out of a polymer material. The connections 25 and 27 are again interlinked over e.g. a capacitor 29. In addition, the coil connections 25 and 27 are connected with connecting wires 31 and 33 which are supplied from the outside.

Figure 4:
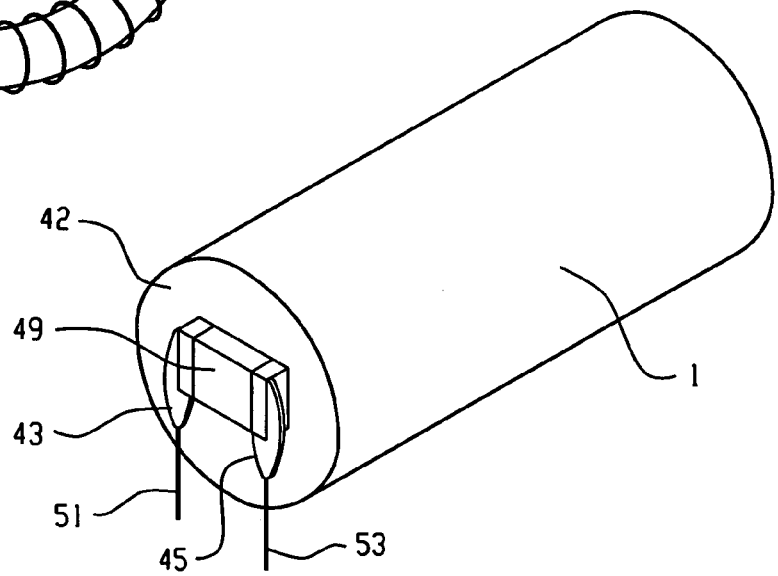

In FIG. 4 the inventive idea is illustrated according to a schematic illustration, as at the front side 42 of a coil 1, which can be e.g. a telephone coil or a so-called t-coil, the connection pads 43 and 45 are arranged onto which the connections of the coil windings are directed. The two connections are interlinked over a so-called SMD-capacitor (Surface Mounted Device Capacitor) 49. Lacings or wires 51 and 53 are directed from the outside onto the two connection pads 43 and 45. The capacitor as shown in FIGS. 1 to 4 is, as proposed according to the present invention, directly soldered onto the coil or t-coil due to limited space and due to the preferable packaging. Therefore, the t-coil must have the two mentioned solderable radial connections which of course have to be big enough and to be set at an appropriate distance so that the (SMD–) capacitor can be arranged. Due to manufacturing reasons and to simplify the mounting of the capacitor and the connection of the external connections, so-called connecting pads are arranged as proposed within FIGS. 1 to 4.

Of course, instead of the capacitor, as shown in FIGS. 1 to 4, any other components may be arranged between the two connections; even the arrangement of an additional circuit is possible. Of course, the arrangement of a component or circuit between the two connections of a smallest coil is not limited to hearing aids, but smallest coils, as described, can also be used within remote control units, medical devices, etc. Besides the receipt of inductive signals in the sense of a so-called telephone coil, such kind of coils can also be used to generate higher frequencies for the modulation of signals to generate smaller inductivities in hearing aids, etc. In addition, it is also possible to equip smallest remote controls for the control e.g. of medical devices, e.g. arranged within a wrist watch, a fingering, etc., with a coil assembly as defined within the present invention.

A further advantage of the coil assembly according to the present invention is e.g. that a plurality of various coils which have different self-resonances can be tuned with appropriate capacities onto always the same resonances and are used exchangeably at the same circuit.

Of course, a plurality of inductivities can also be used on the same coil body or coil bodies which are interlinked.

Figure 5:
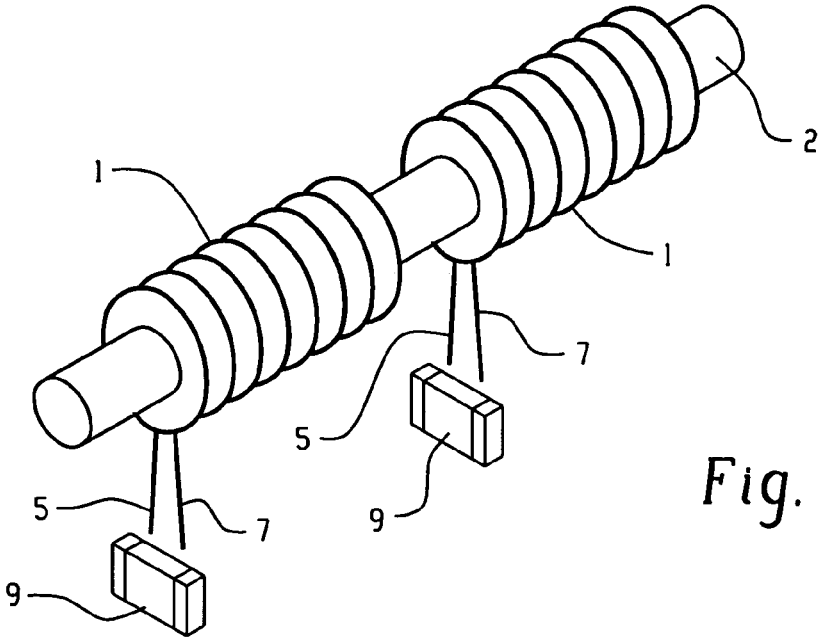

With reference to the FIGS. 5 to 8, examples are shown in which at least two inductivities are arranged on one coil body. FIG. 5 e.g. shows two coaxially arranged inductivities or coils 1 which are arranged coaxially on one coil body 2 and which have each two connections 5 and 7. These connections can be connected over a component, such as e.g. a capacitor, as shown earlier with reference to the FIGS. 1 to 4. To simplify the illustration a capacitor 9 is shown only in outlines, which in correspondence to the respective arrangements within FIGS. 2 and 3 is connected to the connections of the coil on the pads.

Figure 6:
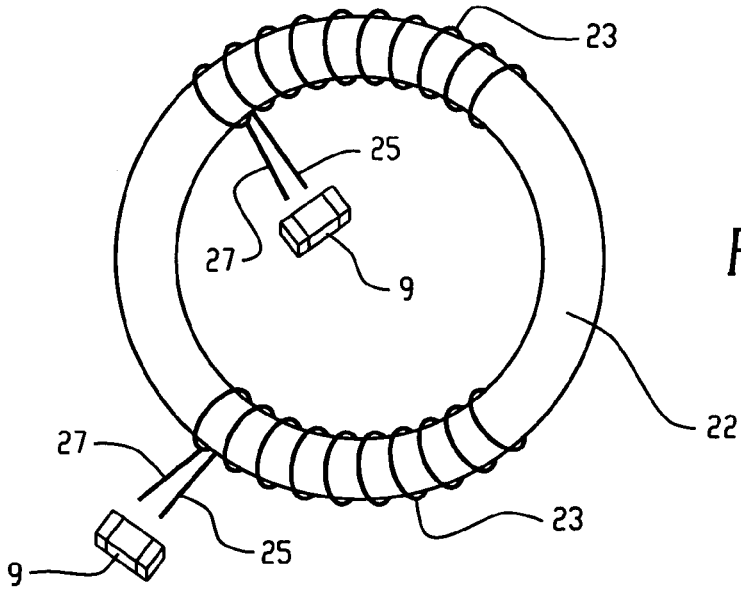
FIG. 6 shows two co-toridally arranged coils.

Analogically, FIG. 6 shows two co-toridally arranged inductivities or coils 23 which are arranged on a ring-shaped coil body 22. Again, the two coils 23 each have connections 25 and 27, which are again interlinked over a component such as a circuit or a capacitor.

Figure 7:
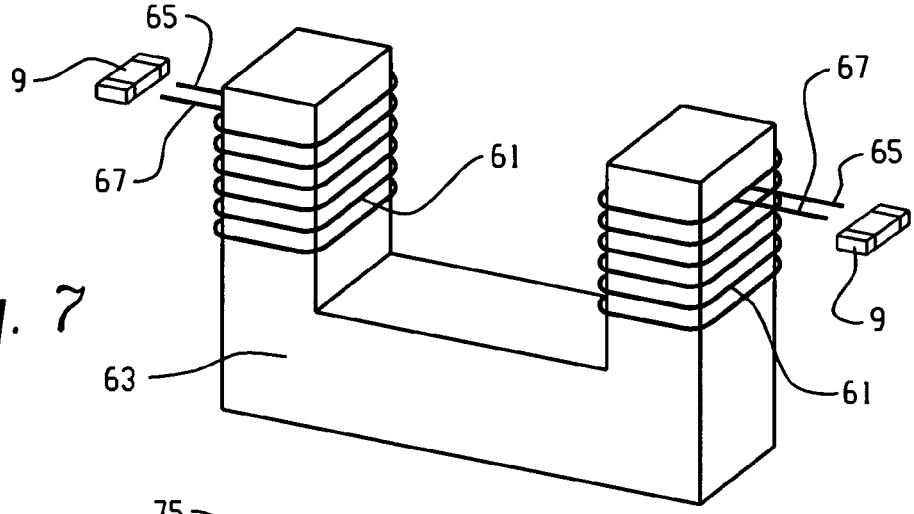
FIG. 7 shows two coils arranged at shanks of an anchor of the body of a current transformer and FIG. 8 shows two concentrically arranged coils.
Figure 8:
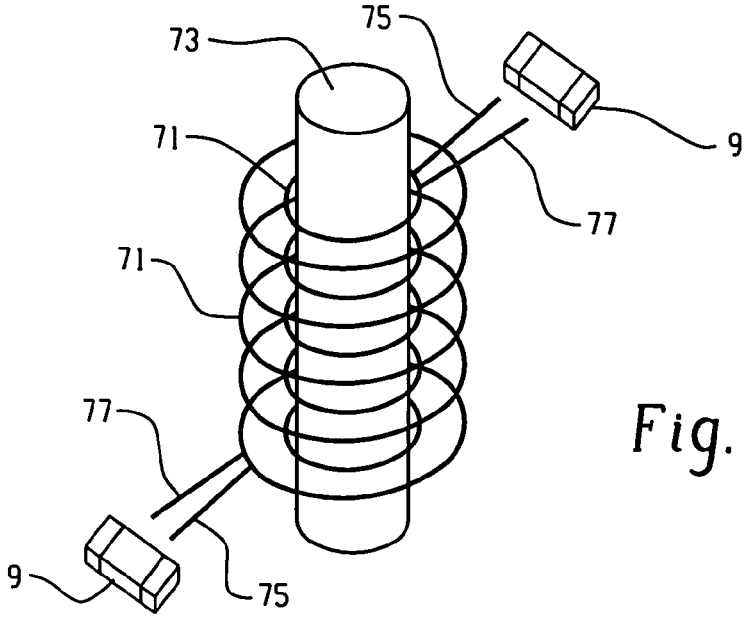

FIG. 7 shows two inductivities or coils 61 which are each arranged on a shank of a U-shaped anchor body 63. The coils 61 each have connections 65 and 67. Finally, FIG. 8 shows two coils or inductivities 71 which are arranged concentrically around a coil body 73, having each connection 75 and 77. Again, these connections may be interlinked by a capacitor or an electronic array.

With the use of FIGS. 5 to 8 it should be demonstrated that a plurality of inductivities or coils can be equipped according to the present invention with respective components or electronic arrays, whereby the invention of course is not limited to two coils or inductivities as the arrangement of three or more inductivities or coils is also possible.

The invention claimed is:

1. A coil assembly for a small electric or electronic device comprising at least one small coil having a plurality of connections, wherein the connections are interlinked by a component mounted directly on or at the coil and the component comprises connecting pads for connecting the coil connections to external connections and further comprising a plate, wherein the connecting pads are operatively attached to the plate and wherein external connections are electrically connected to the connection pads.

2. The coil assembly of claim 1, wherein the component further comprises a capacitor, wherein the capacitor lowers the frequency of remote signals received by the coil, wherein the connecting pads are made from a metallic material, and wherein the plate is made of a polymeric material.

3. The coil assembly of claim 2, wherein the at least one small coil comprises a cylinder-like coil, wherein the plurality of connections are on a front side of the coil.

4. The coil assembly of claim 2, wherein the at least one small coil is a ring-shaped coil, wherein the plurality of connections are arranged at a distance from each other such that the plurality of connections are interlinked by the component.

5. The coil assembly of claim 2 further comprising a coil body, at least two coils are arranged on the coil body, wherein the plurality of connections of the at least two coils are interlinked by one of the component.

6. The coil assembly of claim 5, wherein the coil body is one of a cylindrical shape, ring-shape, or U-shaped.

7. The coil assembly of claim 2, wherein the small electric or electronic device is a hearing aid and wherein the coil assembly receives inductive or high-frequency signals.

8. The coil assembly of claim 2, wherein the small electric or electronic device is a remote control device to control eleciric or electronic devices in the medical field such as a hearing aid.

9. The coil assembly of claim 2, wherein the small electric or electronic device transmits telecommunications signals.

10. The coil assembly of claim 1, wherein the connections are directly mounted onto the connecting pads.

11. The coil assembly of claim 10, wherein a plate is mounted directly onto the connecting pads.

12. The coil assembly of claim 11, wherein the plate is coupled to an end face of the coil.

13. The coil assembly of claim 10, wherein external connections are directly mounted onto the connecting pads.

14. The coil assembly of claim 1, further comprising a capacitor directly mounted onto the coil.

15. The coil assembly of claim 1, wherein the component is mounted on an end face of the coil.

16. A method for the production of a coil assembly comprising the steps of:

providing a coil having a plurality of connections, a coil body, a plate, connecting pads operatively connected to the plate;

arranging the coil on the coil body;

directing the plurality of connections to the connecting pads; and, interlinking the plurality of connections by a component.

17. The method of claim 16 further comprising the step of connecting external connections to the connecting pads.

* * * * *

UNITED STATES PATENT AND TRADEMARK OFFICE

CERTIFICATE OF CORRECTION

PATENT NO. : 7,177,436 B2
APPLICATION NO. : 10/810945
DATED : February 13, 2007
INVENTOR(S) : Jan Frieding It is certified that error appears in the above-identified patent and that said Letters Patent is hereby corrected as shown below:

In Column 2:

Line 26, please delete “co-toridally”, and insert therefor --co-toroidally--.

In Column 3:

Line 53, please delete “co-toridally”, and insert therefore --co-toroidally--.

In Column 4:

Line28, please delete “are” (per Examiner’s Amendment old claim 18 new claim 5).

Line 29, please delete the first word “wherein” (per Examiner’s Amendment).

Line 30, please delete the words “on of” (per Examiner’s Amendment).

Signed and Sealed this

Thirty-first Day of July, 2007

JON W. DUDAS
*Director of the United States Patent and Trademark Office*